US012195060B2

(12) United States Patent
Mazzone

(10) Patent No.: US 12,195,060 B2
(45) Date of Patent: Jan. 14, 2025

(54) METHOD FOR DETECTING A TUNNEL ENTRY OR A TUNNEL EXIT OF A RAIL VEHICLE, OPERATING METHOD, AS WELL AS RAIL VEHICLE

(71) Applicant: Bombardier Transportation GmbH, Berlin (DE)

(72) Inventor: Andrea Mazzone, Zürich (CH)

(73) Assignee: Bombardier Transportation GmbH, Berlin (DE)

( * ) Notice: Subject to any disclaimer, the term of this patent is extended or adjusted under 35 U.S.C. 154(b) by 160 days.

(21) Appl. No.: 18/024,396

(22) PCT Filed: Aug. 31, 2021

(86) PCT No.: PCT/EP2021/074038

§ 371 (c)(1),
(2) Date: Mar. 2, 2023

(87) PCT Pub. No.: WO2022/049079

PCT Pub. Date: Mar. 10, 2022

(65) Prior Publication Data

US 2023/0311958 A1 Oct. 5, 2023

(30) Foreign Application Priority Data

Sep. 3, 2020 (DE) ..... 10 2020 211 117.0

(51) Int. Cl.
*B61L 15/00* (2006.01)
*B61K 9/08* (2006.01)

(52) U.S. Cl.
CPC ..... *B61L 15/0058* (2024.01); *B61K 9/08* (2013.01); *B61L 15/0072* (2013.01)

(58) Field of Classification Search
CPC .... B61L 15/0058; B61L 15/0072; B61K 9/08
See application file for complete search history.

(56) References Cited

U.S. PATENT DOCUMENTS 10,520,603 B2 12/2019 Narula et al.
2013/0067887 A1* 3/2013 Heverley, III ..... F01N 3/021 60/288

(Continued)

FOREIGN PATENT DOCUMENTS

CN 109489584 A 3/2019
DE 4238034 C1 3/1994

(Continued)

*Primary Examiner* — Jacob M Amick
(74) *Attorney, Agent, or Firm* — The Webb Law Firm

(57) ABSTRACT

A method for operating a rail vehicle includes depicting a spatial area in front of the rail vehicle in at least one image by at least one image capturing device and detecting a presence of a tunnel entrance or a tunnel exit prior to an entry or exit of the rail vehicle into or from a tunnel by evaluating at least one image. The method further includes generating at least one control signal for at least one rail vehicle system when a presence of the tunnel entrance is detected prior to the entry of the rail vehicle into a tunnel or when the presence of the tunnel exit is detected prior to the exit of the rail vehicle from the tunnel. The rail vehicle system may be a pantograph control system of the rail vehicle, or a climate control system or a ventilation system of the rail vehicle.

8 Claims, 1 Drawing Sheet

(56) References Cited

U.S. PATENT DOCUMENTS

| | | | | |
|---|---|---|---|---|
| 2014/0208739 | A1* | 7/2014 | Mischler | F02D 41/0007 60/602 |
| 2015/0145962 | A1 | 5/2015 | Jeong et al. | |
| 2020/0023790 | A1* | 1/2020 | Hirai | B60R 11/04 |

FOREIGN PATENT DOCUMENTS

| | | | |
|---|---|---|---|
| DE | 19940350 | A1 | 5/2001 |
| DE | 102010048059 | A1 | 4/2012 |
| DE | 102012215533 | A1 | 3/2014 |
| DE | 102015207026 | A1 | 10/2016 |
| EP | 3528009 | A1 | 8/2019 |
| JP | 2015014490 | A | 1/2015 |
| WO | 2015099463 | A1 | 7/2015 |

* cited by examiner

METHOD FOR DETECTING A TUNNEL ENTRY OR A TUNNEL EXIT OF A RAIL VEHICLE, OPERATING METHOD, AS WELL AS RAIL VEHICLE

CROSS REFERENCE TO RELATED APPLICATIONS

This application is the United States national phase of PCT/EP2021/074038 filed Aug. 31, 2021 and claims priority to German Patent Application No. 10 2020 211 117 filed Sep. 3, 2020, the disclosures of which are hereby incorporated by reference in their entireties.

BACKGROUND OF THE INVENTION

Field of the Invention

The invention relates to a method for operating a rail vehicle as well as a rail vehicle. Further, a method for detecting a tunnel entry or a tunnel exit of a rail vehicle is described.

Description of Related Art

When a rail vehicle, while travelling, enters or exits a tunnel this will result in a typically extremely rapid change of environmental parameters, e.g., an air temperature, an air humidity, and an ambient pressure. Particularly, for example, a change in pressure may occur when the rail vehicle runs into the air present in the tunnel. The intensity of these changes depends on a speed of the rail vehicle.

These changes may have an effect on the functionality of systems in the rail vehicle. Such changes may also affect the ride comfort experienced by a vehicle passenger. For example, the pressure wave experienced or even heard by a vehicle passenger when the train enters a tunnel may potentially be unpleasant.

Moreover, the change may also have an effect on a pantograph of the rail vehicle, particularly on the contact established between the pantograph and an overhead line. For example, the pantograph may lose contact due to the change in pressure. This, in turn, may result in undesired electric arcs.

In order to reduce the effects of the changes in the environmental parameters, particularly of changes in pressure, it is known to design rail vehicles so that they are pressure-tight, or to get them into a pressure-tight state. To this end, e.g., air conditioning systems of the rail vehicle may be equipped with valves which close air inlets when the pressure wave hits the rail vehicle.

From prior art, EP 3 528 009 A1 is known which discloses a system and a method for identifying a tunnel for motor vehicles. The document describes that the detection of a tunnel by a detection system comprising cameras in the vehicle is known. However, the teachings of this document relate to the detection of the tunnel when the vehicle is already in the tunnel. A detection of the tunnel outside the tunnel is not disclosed by the document.

The technical problem arising is to provide a method for operating a rail vehicle as well as a rail vehicle rendering a reliable and early detection and thus operational safety and/or an improved ride comfort possible.

SUMMARY OF THE INVENTION

What is proposed is a method for operating a rail vehicle. The method may comprise a detection of a tunnel entry or a tunnel exit of a rail vehicle.

What is described is a method for detecting a tunnel entry or a tunnel exit of a rail vehicle. Here, a tunnel may refer to an underground structure which, e.g., renders the passage under obstacles such as mountains, water bodies, or other traffic infrastructure possible.

In the method, a spatial area in front of the rail vehicle in the travelling direction is depicted in at least one image. This image is produced by at least one image capturing device. The image capturing device may be an image capturing device of the rail vehicle and therefore be disposed, for example, in or on the rail vehicle.

An image capturing device may be a camera, particularly a CCD or CMOS camera. Of course, also other embodiments of an image capturing device are conceivable which will be discussed in more detail in exemplary embodiments below. For example, an image capturing device may be a black and white camera, a camera for producing depth images, an infrared camera, particularly a short-wave infrared camera, a lidar sensor or a radar sensor for producing two- or three-dimensional images.

Here, the image capturing device is disposed in/on the rail vehicle so that a detection area comprises the spatial area in front of the rail vehicle in the travelling direction.

The at least one image capturing device may be part of a sensor array comprising exactly one or more than one image capturing device. If the sensor array comprises more than one image capturing device the spatial area may be depicted by selected, but not all, or all image capturing devices of the sensor array. In the process, then, a plurality of images can be produced.

Here, within the meaning of the present invention, an image capturing device refers to a device or a sensor which produces a two-dimensional or three-dimensional representation of a surrounding area, this representation referring to an image. Particularly, information about objects in the detection area of the image capturing device, particularly topographic information or information about a shape and/or a size of such objects may be encoded in an image produced by the image capturing device. In other words, an image of objects in the detection area of the image capturing device is produced by the image capturing device.

An image may be a two-dimensional image. As discussed in more detail below, also, a three- or a four-dimensional image may be produced by one or more image capturing devices.

According to the invention, the presence of a tunnel entrance or a tunnel exit is detected by evaluating the at least one image prior to the entry of the rail vehicle into the tunnel or prior to the exit of the rail vehicle from the tunnel.

Therefore, when the rail vehicle is travelling, an image may be produced prior to the entry into the tunnel while travelling, the tunnel entrance being depicted in the image. For detecting the tunnel entrance or the tunnel exit in such an image, image processing and evaluation methods known to the person skilled in the art may be made use of. Such methods may comprise, e.g., segmentation methods, pattern recognition methods, filtering methods, and other processing methods, or a combination of a plurality of such methods. For example, an output signal representing a presence of the tunnel entrance or of the tunnel exit may be produced by the evaluation of the at least one image. When no presence of a tunnel entrance or exit is detected in the at least one image no output signal or an output signal representing the absence may be produced.

This output signal may then be used to control (rail vehicle) systems—as discussed in more detail below.

Here, it has been found that the evaluation of image data renders a particularly reliable and early detection of a tunnel entrance or tunnel exit prior to the point in time when the rail vehicle enters the tunnel or exits this tunnel possible. Therefore, advantageously, such reliable detection is rendered possible. This reliable detection, in turn, advantageously enables an improved, particularly preparatory control of systems of the rail vehicle whereby, in turn, a ride comfort and/or an operational safety of the rail vehicle can advantageously be improved.

In a further embodiment—in addition to the detection of the presence of a tunnel entrance or exit—a current distance between the rail vehicle and the tunnel entrance or the tunnel exit is determined. This distance may also be determined by evaluating the at least one image. For this purpose as well, the person skilled in the art may apply appropriate image processing and evaluation methods. However, the distance may be determined only if the presence of a tunnel entrance or a tunnel exit was detected. Hence, the determination of the distance may be initiated, for example, when an associated output signal was generated during or after the evaluation of the at least one image. In this case, the output signal may be a start signal for the determination of the distance.

If no presence of a tunnel entrance or exit is detected there will be no determination of the distance, or it will not be started.

It is also conceivable that the determination of the distance is performed in a way other than the evaluation of the at least one image. This may particularly mean that the determination of the distance is performed without an evaluation of the image.

In this case, for example, a device for determining the distance which does not evaluate the at least one image of the image capturing device for determining the distance may be used. Such devices for determining the distance are known to the person skilled in the art and may, for example, render an ultrasound-based determination or a determination of the distance utilising other physical measuring principles for the determination of the distance possible.

Moreover, a distance signal representing the value of the distance may be generated when the distance was determined.

In this way, advantageously, a further improved operation of the rail vehicle, particularly a further improvement the operational safety and/or of the riding comfort are achieved since then an operation of a system of the rail vehicle may be additionally controlled depending on this distance. For example, it may be checked whether the distance is equal to a predetermined distance or is within a predetermined distance interval. Then, a distance-specific control or distance interval-specific control of the operation may be performed.

It is also possible to determine a current speed of the rail vehicle and then, depending on the distance, a period of time until the tunnel entrance or exit is reached, an operation of a system of the rail vehicle then being additionally controllable depending on this period of time.

For example, it is possible to initiate a control adapted to the environmental parameters changing due to the tunnel entrance or exit in time, particularly within a predetermined time interval before reaching the tunnel entrance or exit whereby it can be ensured that the adjusted control is implemented in time before reaching it. It can also be ensured that a control adapted to the current environmental parameters is performed for as long as possible. In this case, the control adapted to the changing environmental parameters may not be initiated directly after the detection of the presence of, but only at a point in time depending on the period of time until the tunnel entrance or exit is reached.

For example, it is possible to keep at least one valve of an air duct which may be, e.g., part of an air conditioning system of the rail vehicle which may also be referred to as a climate control system in an opened state for as long as possible before entering a tunnel or in a closed state for as long as possible before exiting a tunnel, and to then change the associated state in time before entering or exiting it, i.e., to close or to open the air duct by controlling the valve. For example, the control signal may be generated 3.1 seconds before the tunnel entrance is reached if it is assumed that the transmission time to the valve is 100 ms, and closing the valve takes 3 seconds. If the vehicle speed is 200 km/h the associated control signal has to be generated 166.6 m in front of the tunnel entrance.

A minimum time value and a maximum time value and a maximum time value of the time interval may be selected depending on the system and/or the application here.

In a further embodiment, the distance is determined by evaluating the at least one image. This was already explained above. In this way, it is advantageously achieved that two pieces of information, namely both information about the presence and information about the distance, can be generated by evaluating the at least one image which, in turn, renders a cost-effective and installation space-saving realisation of a device for carrying out the method possible since particularly no separate device for determining the distance has to be provided.

In a further embodiment, respectively one image of a spatial area in front of the rail vehicle in the travelling direction is depicted by a plurality of image capturing devices, the presence of the tunnel entrance or of the tunnel exit being detected by evaluating the images prior to the entry of the rail vehicle into the tunnel or prior to the exit of the rail vehicle from the tunnel. In this case, the rail vehicle may comprise a plurality of image capturing devices disposed in the or on the rail vehicle. Here, the plurality of image capturing devices may respectively be a detecting device of a sensor array. Detection areas of these image capturing devices may overlap here, the overlapping area particularly also comprising the area in front of the rail vehicle in the travelling direction.

This plurality of image capturing devices may be image capturing devices of the same type which means that these image capturing devices produce an image based on the same measuring principle. For example, the rail vehicle may comprise a plurality of cameras, i.e., e.g., CMOS or CCD cameras.

The image capturing devices may also comprise a plurality of image capturing devices of different types. This may mean that two image capturing devices which are different from each other respectively produce one image based on different physical measuring principles. For example, a first image capturing device may be a camera, another image capturing device being a lidar or radar sensor for producing a two- or three-dimensional image.

It is possible that each image is separately evaluated and that the presence of the tunnel entrance or exit is verified for each image. Then, the presence of the tunnel entrance or exit may be detected when it is detected in more than a predetermined percentage of all images. If the tunnel entrance or exit is not detected in this predetermined percentage of the images no presence of such an entrance or exit is detected.

Of course, is it also possible to only detect the tunnel entrance or exit when it is detected in all images produced by the plurality of image capturing devices. Otherwise, no tunnel entrance or exit is detected.

In this way, advantageously, a robustness of the detection is increased whereby the reliability of the method, i.e., the reliability of the detection, is also advantageously improved.

In a further embodiment, the images produced by the image capturing devices are fused, the presence of the tunnel entrance or the tunnel exit being detected by evaluating the fused image. Here, the person skilled in the art may apply appropriate methods for fusing images. Thus, not all or a plurality of images produced by various image capturing devices are evaluated, but only a single fused image. In this way, a computational effort for detecting the tunnel entrance or exit can be reduced, particularly when fusing requires less computational effort than the evaluation of a plurality of images. At the same time, the reliability of the detection is advantageously increased.

In a further embodiment, at least one of the image capturing devices is a CMOS- or CCD-camera, and at least one other image capturing device is a lidar or radar sensor capable of producing a two- or three-dimensional image.

It is further possible that two or more than two of the plurality of image capturing devices are the image capturing devices of a stereo camera system. In this case, it is possible that the rail vehicle comprises two or more than two image capturing devices, at least two or precisely two of these image capturing devices being part of a stereo camera system.

In this case, it is further possible that the image produced by the stereo camera system, particularly the three-dimensional image produced by means of the stereo camera system is fused with a two-dimensional image from at least one further image capturing device. This may therefore mean that, prior to the combination, a three-dimensional image is produced from the two-dimensional images of the image capturing device of the stereo camera system which is then fused with at least one other image.

In this case, it is also possible that the three-dimensional image produced by the stereo camera system is evaluated to detect the presence of a tunnel entrance or tunnel exit. In this case, therefore, the three-dimensional image produced in this way may refer to the image of the at least one image capturing device.

The utilisation of the image capturing devices mentioned above advantageously results in a simple production of a device for detecting the tunnel entrance or the tunnel exit since these image capturing devices are usually readily available and partly already present in the rail vehicle.

In a further embodiment, the tunnel entrance or the tunnel exit is detected by methods for shape recognition or by methods of machine learning. Here, associated methods are known to the person skilled in the art. In this way, advantageously, a reliable detection is achieved, particularly for various light conditions. A preferred method of machine learning is the use of a neural network trained in advance to detect the presence of a tunnel entrance or a tunnel exit in one or a plurality of image(s).

According to the invention, a method for operating a rail vehicle is proposed. Here, a spatial area in front of the rail vehicle in the travelling direction is depicted by at least one image capturing device in at least one image, at least one control signal for at least one rail vehicle system being generated if, prior to the entry of the rail vehicle into a tunnel, the presence of a tunnel entrance, or prior to the exit of the rail vehicle from the tunnel, the presence of a tunnel exit is detected by means of a method for detecting a tunnel entrance or a tunnel exit according to one of the embodiments described in the present disclosure.

Here, the control signal may also be generated prior to the entry or prior to the exit.

A rail vehicle system may particularly be a driver assistance system of the rail vehicle, particularly for adjusting dynamic driving properties or parameters such as, e.g., a speed. A rail vehicle system may also be a system which adjusts properties or parameters of the rail vehicle which are not associated with driving dynamics, for example properties of a passenger compartment of the rail vehicle such as, e.g., a temperature or a lighting state. Here, the rail vehicle system may comprise at least one control device disposed in or on the rail vehicle. Furthermore, the rail vehicle system may comprise at least one actuator also disposed in or on the rail vehicle. For example, this actuator may be controlled by the control device. The control signal may be generated by an evaluation device which evaluates the at least one image.

Moreover, the control signal may be transmitted to the rail vehicle system, particularly the control device of this rail vehicle system. For this purpose, the associated devices may be connected in terms of data and/or signalling technology, for example via a bus system.

It is conceivable that the control signal, in addition to information about the presence of a tunnel entrance or exit, also includes information about a distance to the tunnel entrance or to the tunnel exit. In addition to the presence—as explained above—also the distance may be determined to this end. It is also possible that a distance- or distance range-specific control signal is produced.

In this way, advantageously, an improved operation of the rail vehicle is achieved, particularly by the timely adjustment of the operation to the environmental parameters changing due to the tunnel entrance or tunnel exit.

Further, the rail vehicle system is a pantograph control system or a climate control system of the rail vehicle.

The rail vehicle system may also be a ventilation system of the rail vehicle.

Here, the climate control system or ventilation system may comprise at least one air duct which connects an interior space of the rail vehicle to an external surrounding area or is part of such a connection. Moreover, the system may comprise at least one valve and/or at least one flap by means of which this air duct can be transferred into an opened or a closed state. In general terms, an opening state of the air duct may be adjustable. Particularly, a closed state in which the interior space is not fluidically connected to the external surrounding area via the air duct, or an opened state in which the interior space is fluidically connected to the external surrounding area via the air duct can be set. Intermediate states may also be selectable. The rail vehicle, particularly the system, may comprise appropriate adjusting means for the adjustment.

Depending on the control signal generated as explained above, the opening state of the air duct may then be set to a predetermined state, e.g., the at least one air duct may be transferred into an opened or closed state, e.g. by an associated control of the valve. This may mean that the opening state is changed when it does not correspond to the predetermined state. For example, when the presence of a tunnel entrance is detected, the opening state of the air duct may be adjusted or set to a tunnel entry-specific state, particularly to the closed state, particularly after a predetermined or speed-dependent period of time after the point of time of the detection. When the presence of a tunnel exit is detected the air duct may be set to a tunnel exit-specific state, e.g., a closed state or an opened state, particularly after a predetermined or speed-dependent period of time after the point in time of the detection. Here, the speed-dependent period of time may be determined as described with respect to the contact pressure force below, particularly in an allocation-based or distance-based manner.

For example, it is possible that a point in time of the opening or closing is determined depending on the distance and, when appropriate, a vehicle speed, and that then the air duct is opened or closed at this associated point in time.

It is further possible that, after the tunnel entrance or the tunnel exit has been passed, the opening state set for the passage or during the passage as described is changed again. For example, the closed state set for the passage or during the passage may be reset to an opened state. It is therefore possible that the closed state set for the passage or during the passage of a tunnel entrance which prevents the tunnel-induced pressure pulse from being felt and/or heard in the interior space is reset to an opened state before the tunnel exit is reached. Then, it can be reset to a closed state for the passage or during the passage of the tunnel exit. The repeated change of the state set after the passage of the tunnel entrance or of the tunnel exit may particularly be induced after a predetermined or speed-dependent period of time. Here, the change may be performed at a predetermined speed, i.e., a rapid or slow opening or closing may be performed. Particularly, the speed of the change upon a renewed change of the state set after the passage the tunnel exit may be higher, but preferably lower than the speed of the change upon a renewed change of the state set after the passage of the tunnel entrance.

Alternatively or cumulatively, the opening state may be adjusted depending on the pressure, particularly depending on a change in pressure. The pressure may particularly be an external pressure in the surrounding area, particularly on an outer wall of the rail vehicle or an interior pressure in the interior space of the rail vehicle. For example, a closed state can be set when the pressure or the change in pressure is larger than a predetermined threshold. When driving in a tunnel, the external pressure may be higher than during travel not leading through a tunnel.

Alternatively or cumulatively, the opening state may further be adjusted depending on a carbon dioxide concentration in the interior space of the rail vehicle. This concentration may be detected by, e.g., at least one sensor. For example, an opened or partly opened state may be set when the concentration is higher than a predetermined threshold. Generally, it is desired to minimise the adjustment of a closed state which leads to an increase in the carbon dioxide concentration. This may advantageously be achieved by the speed-dependent adjustment described above and the renewed change of the opening state.

In this way, advantageously, an increased ride comfort is achieved since particularly a pressure wave produced by the changing environmental parameters can be prevented from being felt or heard by a vehicle passenger.

If the rail vehicle system is a pantograph control system a contact pressure force by which the pantograph is pressed against an overhead line may be increased when the presence of the tunnel entrance or of a tunnel exit is detected, whereat the contact pressure force may be changed, for example, after a predetermined or speed-dependent period of time after the point of time of the detection, particularly to a predetermined or speed-dependent value. Particularly, the contact pressure force may be increased. However, is also conceivable that the contact pressure force is decreased. The change may be performed in accordance with a change profile, whereat a period of time of the change and a time-based change of the contact pressure force may be predetermined by this profile.

As explained above, it is, e.g., possible to determine a point in time of the increase in the contact pressure force depending on the distance and potentially the vehicle speed, and to then change, particularly to increase the contact pressure force at that associated point in time. The speed-dependent period of time may be determined, e.g., based on an allocation of speeds to periods of time known in advance, the period of time being determined as the period of time allocated to the current speed. Here, the current speed may be determined by, e.g., a speed sensor of the rail vehicle or depending on output signals of other sensors, particularly also by evaluating images. Alternatively, the speed-dependent period of time may be determined by determining a distance between the rail vehicle and the tunnel entrance and by determining the period of time until the tunnel entrance is reached depending on the distance and a vehicle speed. The speed-dependent period of time may then be equal to the period of time until it is reached or be smaller than this period of time by a predetermined amount.

Accordingly, the contact pressure force changed, particularly increased for a tunnel entrance may be changed again, particularly decreased upon detection of the presence of a tunnel exit, particularly—analogous to the above explanations—after a predetermined or speed-dependent period of time. For example, the contact pressure force may be reset to the value set before the tunnel entrance was reached. The contact pressure force may also be changed to a predetermined or speed-dependent value.

It is also possible that, depending on the distance, a point in time of the reduction of the contact pressure force is determined, and that it is then only changed at this point in time. On the other hand, is it also possible that a contact pressure force changed for a tunnel entrance or exit is reduced again after the entry into the tunnel, i.e., independent of the detection of the presence of a tunnel exit, or after the exit from the tunnel, e.g. directly after the entry or the exit, or a predetermined period of time after the entry or exit.

This advantageously results in an increased operational safety, particularly since a contact loss between the pantograph and the overhead line due to the changing environmental parameters can be reduced which in turn reduces electric arcs.

Further proposed is a rail vehicle comprising at least one image capturing device and at least one evaluation device. This evaluation device may be implemented as or comprise a microcontroller or an integrated circuit. A spatial area in front of the rail vehicle in the travelling direction is depictable in at least one image by the at least one image capturing device.

Moreover, the presence of a tunnel entrance or a tunnel exit is detectable prior to the entry of the rail vehicle into the tunnel or prior to the exit of the rail vehicle from the tunnel by the evaluation of the at least one image by means of the evaluation device.

The rail vehicle is therefore configured so that a method for detecting a tunnel entrance or a tunnel exit according to one of the embodiments described in the present disclosure including the associated technical advantages is performable by the rail vehicle.

Furthermore, it is possible that the rail vehicle comprises a control device for generating a control signal depending on the detection of the presence of a tunnel entrance or a tunnel exit. In this case, the rail vehicle is designed to perform a method for operating a rail vehicle according to one of the embodiments disclosed in this invention including the associated technical advantages. Particularly, at least one control signal may be generated for at least one rail vehicle system if the presence of a tunnel entrance is detected prior to the entry of the rail vehicle into a tunnel or the presence of a tunnel exit is detected prior to the exit of the rail vehicle from the tunnel, the rail vehicle system being a pantograph control system of the rail vehicle, and a contact pressure force by which the pantograph is pressed against an overhead line being changed after a speed-dependent period of time after a point of time of the detection when the presence of the tunnel entrance is detected, or the rail vehicle system being a climate control system or a ventilation system of the rail vehicle which comprises at least one air duct, an opening state of the air duct being adjusted to a predetermined state after a speed-dependent period of time after the point of time of the detection when the presence of the tunnel entrance is detected.

Further, the rail vehicle may comprise a plurality of image capturing devices.

The rail vehicle may also comprise at least one controllable device controllable by a control signal generated as explained above. For example, the rail vehicle may comprise at least one controllable valve which may be transferred into an opened or a closed state by a control signal generated as explained above, whereat, in the closed state, for example, an air duct may be blocked by the valve, and opened in the opened state. However, the controllable device may also comprise or be configured as a light source. The controllable device may be part of a rail vehicle system.

The rail vehicle may also comprise a controllable pantograph, a contact pressure force of the pantograph on an overhead line being adjustable.

Furthermore, is it conceivable that also the distance of the rail vehicle from the tunnel entrance or the tunnel exit is determinable by the evaluation device or another evaluation device of the rail vehicle, and that the control signal, e.g. a point in time of the generation of the control signal, is then generated depending on the distance.

Likewise, is it conceivable that the rail vehicle comprises a device for determining a speed of the rail vehicle, whereat the control signal, e.g. a point in time of the generation of the control signal, may additionally be generated depending on the current speed. Furthermore, the rail vehicle may comprise at least one of the rail vehicle systems explained above. These may be controlled depending on the presence, and potentially the distance, and further potentially the speed.

BRIEF DESCRIPTION OF THE DRAWINGS

The invention is explained in more detail based on embodiments. In the Figures.

In the following, the same reference numerals designate elements having the same or similar technical features.

DESCRIPTION OF THE INVENTION

Figure 1:
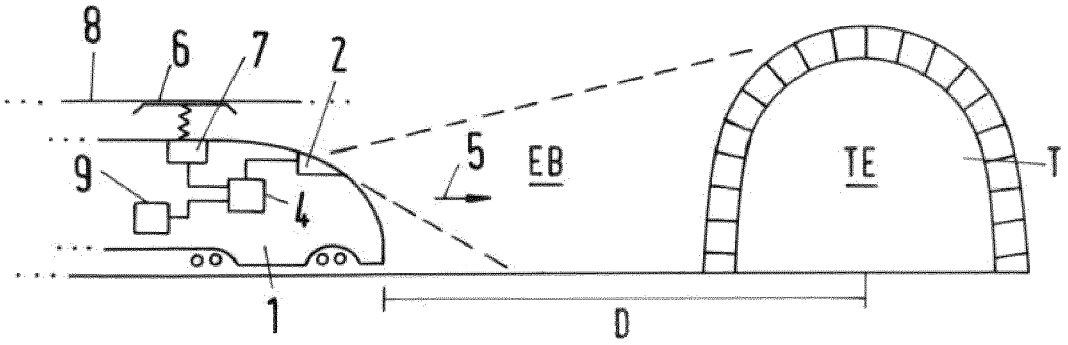
FIG. 1 shows a schematic illustration of a rail vehicle according to the invention.

FIG. 1 shows a schematic illustration of a rail vehicle 1 configured to carry out a method for detecting a tunnel entrance TE or a tunnel exit (not illustrated) of the rail vehicle 1.

Moreover, it is illustrated in FIG. 1 that a tunnel T having a tunnel entrance TE is located in front of the rail vehicle 1 in the travelling direction 5. Likewise illustrated is a distance D between the rail vehicle and the tunnel entrance TE.

The rail vehicle comprises a sensor array 2 including at least or precisely one image capturing device 3 (see FIG. 3*a*) and a control and evaluation device 4 connected to the sensors 3, 3*a*, 3*b*, 3*c* (see FIGS. 3*a*, 3*b*, 3*c*) of the sensor array 2 in terms of data and/or signalling technology. What is illustrated is a detection area EB of the image capturing device(s) 3, 3*a*, 3*b*, 3*c* of the sensor array 2 which—in an embodiment including a plurality of image capturing device(s) 3, 3*a*, 3*b*, 3*c*—may particularly be a common detection area EB of all image capturing devices 3, 3*a*, 3*b*, 3*c*.

A travelling direction of the rail vehicle 1 is represented by an arrow 5. Consequently, it can be seen in FIG. 1 that a spatial area 5 in front of the rail vehicle 1 in the travelling direction can be depicted by the image capturing devices 3, 3*a*, 3*b*, 3*c* of the sensor array 2.

The control and evaluation device 4 may then evaluate the at least one image A (see FIG. 2*a*) to detect a tunnel entrance TE in the at least one image A. For this purpose, known image processing and evaluation methods may be applied, particularly, methods of shape recognition and/or machine learning methods, preferably neural networks may be used.

Further, a pantograph 6 of the rail vehicle and an apparatus 7 for adjusting a contact pressure force of the pantograph 6 on an overhead line 8 are illustrated. This apparatus 7 is connected to the evaluation device 4 in terms of data or signalling technology. Likewise illustrated is a climate control system 9 for air-conditioning and/or ventilating a vehicle interior of the rail vehicle 1.

Figure 2A:
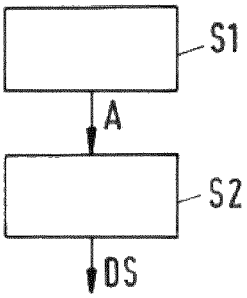
FIG. 2*a* shows a schematic flow diagram of a method for detecting a tunnel entrance or a tunnel exit.
Figure 2B:
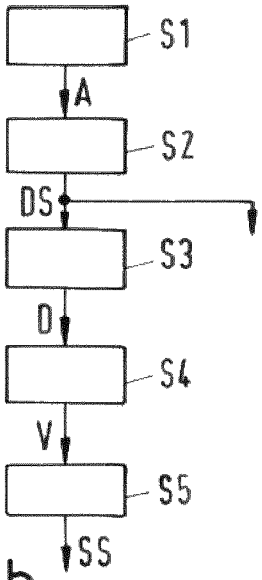
FIG. 2*b* shows a schematic flow diagram of a method for operating a rail vehicle according to the invention.

This apparatus/system 7, 9 may comprise actuators, for example motors or controllable valves which can be controlled by control signals SS (see FIG. 2*b*). These control signals SS may be generated by the control and evaluation device 4 depending on a detected tunnel entrance TE.

Of course, other controllable devices of the rail vehicle 1 not shown, e.g. a lighting system, may also be in data or signalling connection to the evaluation device 4 and controlled by control signals SS.

The control and evaluation device 4 may be implemented as or comprise, for example, a microcontroller.

FIG. 2*a* shows a schematic flow diagram of a method for detecting a tunnel entry TE (see FIG. 1) or a tunnel exit of a rail vehicle 1 according to the invention.

In a first step S1, a spatial area in front of the rail vehicle 1 in the travelling direction 5 is depicted in at least one image A by at least one image capturing device 3, 3*a*, 3*b*, 3*c* of a sensor array 2.

In a second step S2, the at least one image A is evaluated to detect the presence of the tunnel entrance TE or of a tunnel exit prior to the entry of the rail vehicle 1 into the tunnel T or prior to the exit of the rail vehicle 1 from the tunnel T. When a tunnel entrance TE or a tunnel exit is detected, a detection signal DS is generated. When no tunnel entrance TE or no tunnel exit is detected no detection signal DS is generated.

FIG. 2*b* shows a schematic flow diagram of a method for operating a rail vehicle 1 according to the invention (see FIG. 1). Here, the first two steps S1, S2 correspond to the embodiment of the first two steps S1, S2 shown in FIG. 2*b* of the embodiment illustrated in FIG. 2*a*.

In a third step S3 which is only performed when a detection signal DS was generated (i.e., when a tunnel entrance TE or a tunnel exit was detected prior to the entry or exit), a distance D (see FIG. 1) between the rail vehicle 1 and the tunnel entrance TE or the tunnel exit is determined. In a fourth step S4, then, a speed V of the rail vehicle 1 is determined.

In a fifth step S5, then, a control signal depending on the detection signal DS, the distance D, and the vehicle speed V is generated. This may mean that properties of the control signal SS may be adjusted depending on the detection signal DS, the distance D, and the vehicle speed V. Such a property may be, e.g., a point in time of the initiation of the performance of a function to be controlled by the control signal. Another property may be a magnitude of a target value of a parameter to be produced by an actuator of a controllable apparatus controllable by the control signal SS or of a controllable vehicle system of the rail vehicle 1.

For example, a contact pressure force by which the pantograph 6 is pressed against an overhead line 8 can be changed after a speed-dependent period of time after a point of time of the detection when the presence of a tunnel entrance TE or a tunnel exit is detected (see FIG. 1). Alternatively or cumulatively, an opening state of an air duct connecting a vehicle interior to an external surrounding area of the rail vehicle 1 may be adjusted to a predetermined state after a speed-dependent period of time after the point of time of the detection when the presence of the tunnel entrance TE or a tunnel exit is detected. The opening state may be adjusted, for example, by a valve of the climate control system 9.

Particularly, therefore, it is possible that a control signal SS is only generated when a detection signal DS was produced. If no distance D and/or no vehicle speed V are determined the control signal SS may be generated with predetermined properties, particularly at a predetermined point in time. If the distance and/or the vehicle speed V is determined the property of the control signal may be additionally determined and adjusted depending on these parameters. Of course, it is possible that—if a distance D and no vehicle speed V is determined—a control signal SS having at least one property depending on the distance D, but not on the vehicle speed V is generated.

If no distance D is determined the speed-dependent period of time may be determined in an allocation-based manner.

Hence, the determination of the distance in the fourth step S4 and the determination of the vehicle speed V in the fifth step S5 are optional.

Figure 3A:
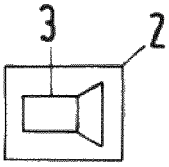
FIG. 3*a* shows a schematic illustration of a sensor array in a first embodiment.

FIG. 3*a* shows a schematic illustration of a sensor array 2 according to a first embodiment. In this embodiment, the sensor array 2 comprises an image capturing device 3 which may particularly be configured as a camera, for example a CCD-camera or a CMOS-camera. It is possible that the camera is a black and white camera, a camera for producing depth images or an infrared camera, particularly a short-wave infrared camera. The image capturing device 3 may also be a lidar sensor or a radar sensor for producing two- or three-dimensional images. Any other sensor or sensors generating signals based on other physical operating principles for producing two- or three-dimensional images is suitable, e.g. ultrasound- or electric impulse-based sensors.

Figure 3B:
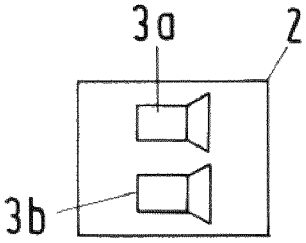
FIG. 3*b* shows a schematic illustration of a sensor array according to a further embodiment.

FIG. 3*b* shows a schematic illustration of a sensor array 2 according to another embodiment. The sensor array 2 comprises a first and another image capturing device 3*a*, 3*b*. These may be image capturing devices 3*a*, 3*b* of a stereo camera system. It is possible to determine the distance D (see FIG. 1) between rail vehicle 1 and tunnel entrance TE by evaluating the images A produced by the stereo camera system. For this purpose, so-called stereo matching methods may be applied.

It is also possible to use a lidar/radar sensor for determining the distance D which may, for example, produce 4D radar information.

Figure 3C:
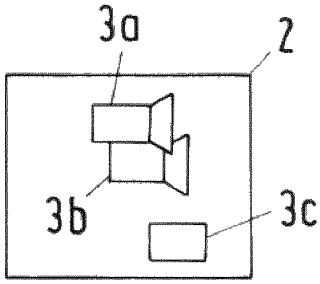
FIG. 3*c* shows a schematic illustration of a sensor array according to a further embodiment.

FIG. 3*c* shows another schematic illustration of a sensor array 2. It comprises a first image capturing device 3*a*, another image capturing device 3*b* which may be formed by, for example, CMOS or CCD cameras. Moreover, the sensor array 2 comprises a lidar/radar sensor 3*c*. The image capturing devices 3*a*, 3*b*, in turn, constitute image capturing devices of a stereo camera system. However, it is also possible that none of the sensors of the sensor array 2 is formed as a CMOS or CCD camera. It is rather also possible that all sensors are formed as a lidar or radar sensor 3*c*. In the embodiment shown in FIG. 3*c* as well as in the embodiments explained above, also a sensor may be used which generates the output signals in accordance with another physical operating principle instead of the lidar/radar sensors 3*c*— as explained above.

The invention claimed is:

1. A method for operating a rail vehicle, the method comprising:

depicting a spatial area in front of the rail vehicle in a travelling direction by at least one image capturing device in at least one image, detecting a presence of a tunnel entrance or a tunnel exit by evaluating the at least one image prior to an entry of the rail vehicle into tunnel or prior to an exit of the rail vehicle from the tunnel, generating at least one control signal for at least one rail vehicle system when a presence of the tunnel entrance is detected prior to the entry of the rail vehicle into the tunnel or when a presence of the tunnel exit is detected prior to the exit of the rail vehicle from the tunnel, wherein the rail vehicle system is a pantograph control system of the rail vehicle and a contact pressure force by which a pantograph is pressed against an overhead line is changed after a speed-dependent period of time after a point of time of the detection when the presence of the tunnel entrance is detected, or wherein the rail vehicle system is a climate control system or a ventilation system of the rail vehicle which comprises at least one air duct, wherein an opening state of the air duct is set to a predetermined state after a speed-dependent period of time after the point of time of the detection when the presence of the tunnel entrance is detected.

2. The method according to claim 1, wherein a distance between the rail vehicle and the tunnel entrance or the tunnel exit is determined when the presence of the tunnel entrance or the tunnel exit is detected.

3. The method according to claim 2, characterised wherein the distance is determined by evaluating the at least one image.

4. The method according to claim 1, wherein respectively one image of the spatial area in front of the rail vehicle in the travelling direction is depicted by a plurality of image capturing devices, wherein the presence of the tunnel entrance or the tunnel exit is detected prior to the entry of the rail vehicle into the tunnel or prior to the exit of the rail vehicle from the tunnel by evaluating the images.

5. The method according to claim 4, wherein the images produced by the plurality of image capturing devices are fused into a fused image, and wherein the presence of the tunnel entrance or the tunnel exit is detected by evaluating the fused image.

6. The method according to claim 4, wherein at least one of the plurality of image capturing devices is a CMOS or CCD camera, and wherein at least one further image capturing device of the plurality of images capturing devices is a LIDAR or a radar sensor.

7. The method according to claim 1, wherein the tunnel entrance or the tunnel exit is detected by methods for shape recognition or by machine learning methods.

8. A rail vehicle comprising at least one image capturing device and at least one evaluation device, wherein a spatial area in front of the rail vehicle in a travelling direction is depictable in at least one image by the at least one image capturing device, wherein a presence of a tunnel entrance or a tunnel exit is detectable prior to an entry of the rail vehicle into a tunnel or prior to an exit of the rail vehicle from the tunnel by evaluation of the at least one image using the evaluation device, wherein at least one control signal for at least one rail vehicle system is generated when a presence of the tunnel entrance is detected prior to the entry of the rail vehicle into the tunnel or when a presence of the tunnel exit is detected prior to the exit of the rail vehicle from the tunnel, wherein the rail vehicle system is a pantograph control system of the rail vehicle, and a contact pressure force by which a pantograph is pressed against an overhead line is increased after a speed-dependent period of time after a point of time of the detection when the presence of the tunnel entrance is detected, or wherein the rail vehicle system is a climate control system or a ventilation system of the rail vehicle which comprises at least one air duct, wherein an opening state of the air duct is set to a predetermined state after a speed-dependent period of time after the point of time of the detection when the presence of the tunnel entrance is detected.

* * * * *